US007416434B2

(12) United States Patent
Saha et al.

(10) Patent No.: US 7,416,434 B2
(45) Date of Patent: Aug. 26, 2008

(54) IDC SPLICE CONNECTOR

(75) Inventors: Koushik Saha, Brunswick, OH (US); Ronald K. Brengartner, Jr., Strongsville, OH (US); Paul W. Southard, Broadview Heights, OH (US); Michael F. Augustine, Medina, OH (US); Yu Pan, Shanghai (CN); Matthew S. Mrakovich, Streetsboro, OH (US)

(73) Assignee: Lumination LLC, Valley View, OH (US)

( * ) Notice: Subject to any disclaimer, the term of this patent is extended or adjusted under 35 U.S.C. 154(b) by 0 days.

(21) Appl. No.: 11/539,047

(22) Filed: Oct. 5, 2006

(65) Prior Publication Data

US 2008/0085625 A1 Apr. 10, 2008

(51) Int. Cl.
*H01R 4/24* (2006.01)

(52) U.S. Cl. ..... 439/402

(58) Field of Classification Search ..... 439/402, 439/596, 941, 404, 405, 417, 418, 467, 741, 439/519–521

See application file for complete search history.

(56) References Cited

U.S. PATENT DOCUMENTS

| | | | | |
|---|---|---|---|---|
| 4,954,098 | A | 9/1990 | Hollingsworth et al. | |
| 5,080,606 | A | 1/1992 | Burkard | |
| 5,520,549 | A | 5/1996 | Tanaka et al. | |
| 5,626,489 | A | 5/1997 | Marshall et al. | |
| 5,934,930 | A | 8/1999 | Camps et al. | |
| 6,017,241 | A | 1/2000 | Komai | |
| 6,261,119 | B1 | 7/2001 | Green | |
| 6,406,323 | B2 | 6/2002 | Chung Long Shan | |
| 6,552,268 | B2 | 4/2003 | Daoud et al. | |
| 6,685,497 | B1 * | 2/2004 | Urban et al. | 439/417 |
| 6,761,589 | B2 * | 7/2004 | Venditti et al. | 439/596 |
| 2004/0229495 | A1 * | 11/2004 | Negishi et al. | 439/402 |
| 2005/0227529 | A1 * | 10/2005 | Mrakovich et al. | 439/402 |

* cited by examiner

*Primary Examiner*—Edwin A León
(74) *Attorney, Agent, or Firm*—Fay Sharpe LLP

(57) ABSTRACT

A connector electrically connects corresponding conductors of at least first and second cables. The connector comprises a connecting portion into which the conductors of the first and second cables are inserted opposing one another to electrically connect corresponding conductors of each cable. A positive terminal and a negative terminal terminate and electrically connect corresponding conductors of each cable.

16 Claims, 5 Drawing Sheets

IDC SPLICE CONNECTOR

BACKGROUND

The present application relates to electric connectors. It finds particular application in conjunction with lighting systems and will be described with a particular reference thereto. However, it is to be appreciated that the following also relates to electrical systems and the like.

Insulation displacement connectors (IDC) are used to interconnect conductors which have a wire surrounded by an outer insulating layer. These devices typically include a central body or housing having one or more channels for receiving the conductors, and a metallic contact element such as U-element which provides the electrical connection between the conductors. As the U-element contacts the insulated conductor, the inner walls of the U-element penetrate the outer insulating layer and make contact with the metal wire.

Typically, to connect multi-conductor parallel cables by using commercially available IDC splice connectors the wires are cut and separated. Corresponding cut and separated wires from the two cables are inserted into the connector. The connection is terminated separately for each pair of corresponding wires. Thus, this process must be completed for each set of wires to be connected using a different connector each time.

Other known connectors require a similar process but can connect multiple wires together through an intermediate connecting part so the whole connection requires three separate assemblies, e.g., for three sets of wires.

Such termination procedures are complex and labor intensive. In addition, the miniature lighting products use miniature IDC connectors. When the connectors mentioned above scaled down, they often become fragile and break easily.

BRIEF DESCRIPTION

A connector for electrically connecting corresponding conductors of at least first and second cables is disclosed. The connector comprises a connecting portion into which the conductors of the first and second cables are inserted opposing one another to electrically connect corresponding conductors of each cable. A positive terminal and a negative terminal terminate and electrically connect corresponding conductors of each cable.

In accordance with another aspect, an insulation displacement connector (IDC) for electrically connecting insulated cables which each includes electric conductors is disclosed. A main body includes first and second hinging members. A positive terminal and a negative terminal electrically connect pairs of wires of corresponding conductors by insulation displacement method when the first and second hinging members are snapped closed.

In accordance with another aspect, an insulation displacement connector (IDC) for electrically connecting at least first and second cables each cable having parallel electric wires insulated from one another by a layer of insulative material is disclosed. A connecting portion includes wire receiving slots and wire aligning members, into which wire receiving slots the wires surrounded by the insulative material are inserted. A positive terminal and a negative terminal each has a bifurcated end and is oriented toward a corresponding wire receiving slot. Each bifurcated end pierces the insulative layer of a respective wire and establishes electrical contact with the respective wire.

DETAILED DESCRIPTION

Figure 1:
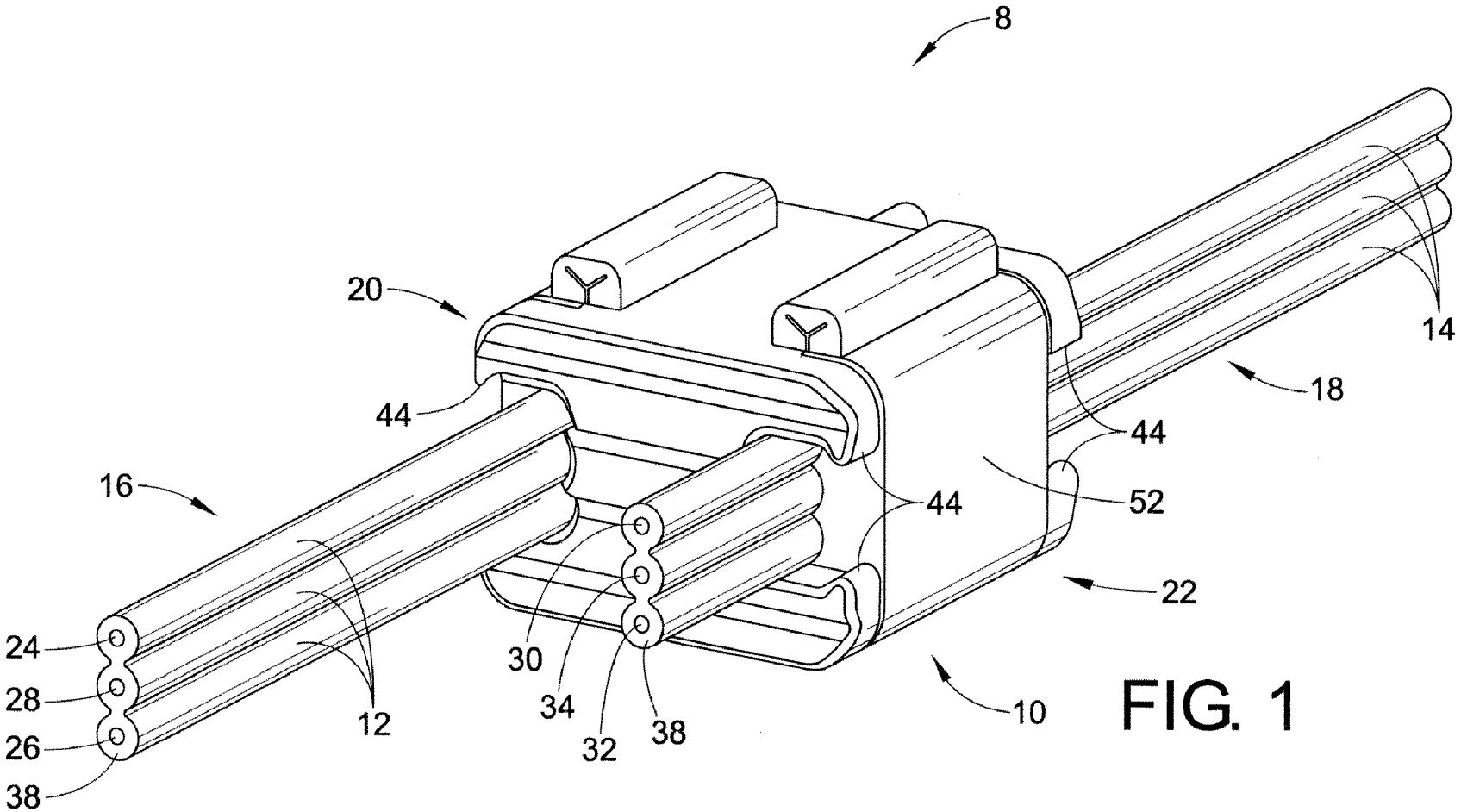
FIG. 1 is a diagrammatic illustration of an assembled connector.
Figure 2:
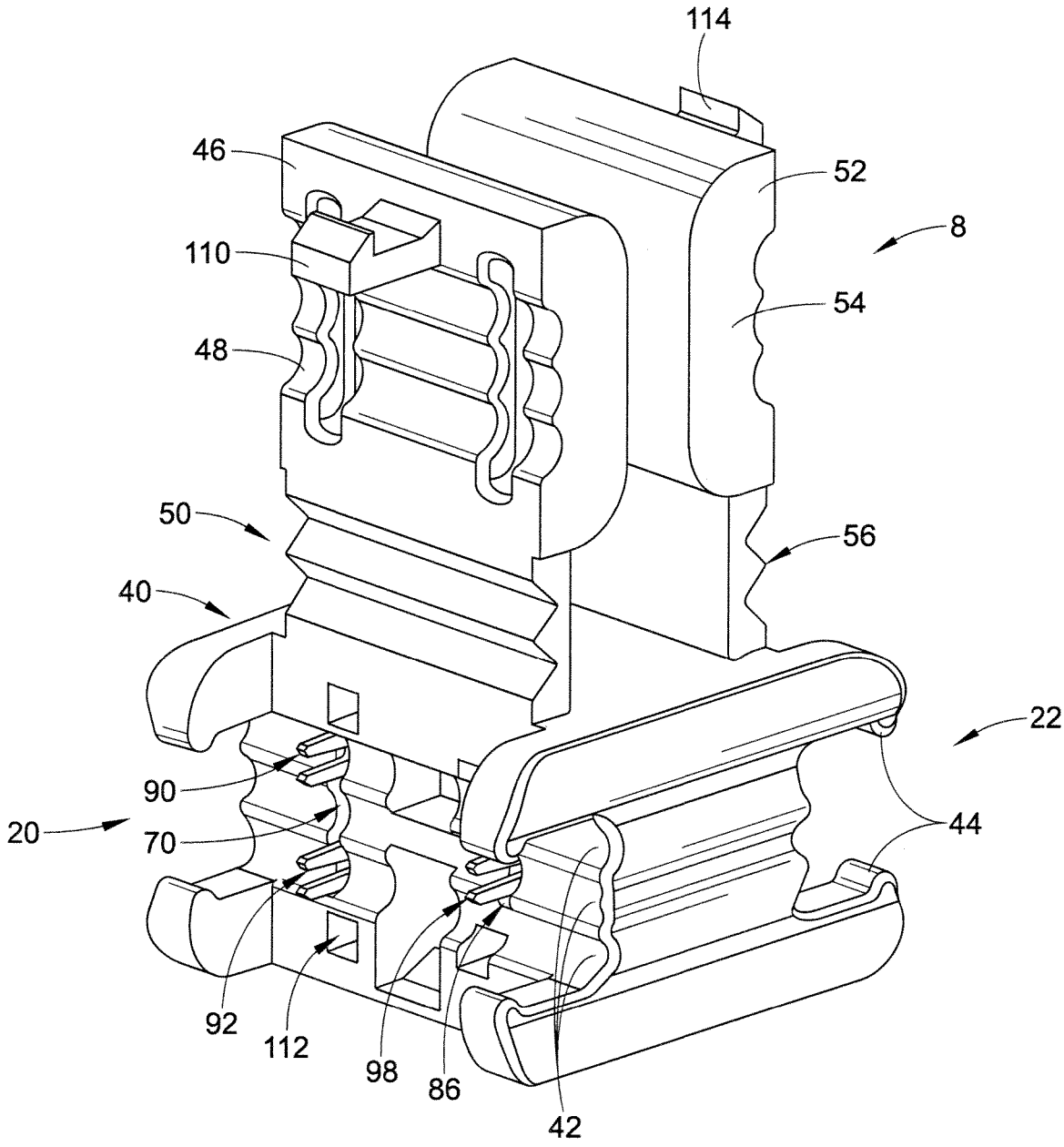
FIG. 2 is a diagrammatic illustration of a connector.

With reference to FIGS. 1 and 2, an electrical connector 8, such as an insulation displacement connector (IDC), includes a housing or main body 10 which is made of, for example, a soft plastic material such as insulating polypropylene or nylon. The main body 10 receives conductors 12, 14 of first and second multi-conductor parallel cables 16, 18 on opposing sides 20, 22. In one embodiment, the first multi-conductor parallel cable 16 includes a first positive wire 24, a second positive wire 26 and a negative wire 28 disposed between the first and second positive wires 24, 26. Likewise, the second multi-conductor parallel cable 18 includes a first positive wire 30, a second positive wire 32 and a negative wire 34 disposed between the first and second positive wires 30, 32. Each wire 24, 26, 28, 30, 32, 34 is surrounded by a layer 38 of insulating material or sheath. Such cable construction with two positive wires disposed on the outside of the cable and the negative wire disposed in between the positive wires affords polarity insensitive connection. E.g., the cables are orientation insensitive which substantially simplifies installation. Of course, it is contemplated that the first and second cable can have any number of wires, such as one, two, four, five, six and the like.

The main body 10 includes a connecting portion 40 including wire receiving slots 42 of substantially circular geometry, in which conductors 12, 14 of the first and second cables 16, 18 are arranged. The connecting portion 40 retains and aligns the corresponding wires to be connected. Nubs 44 assist in retaining the conductors 12, 14. As explained in detail below, a first hinging portion or section 46 including substantially circular wire slots 48 and a hinge 50 mechanically snaps onto the first cable 16. A second hinging portion or section 52 including substantially circular wire slots 54 and a hinge 56 mechanically snaps onto the second cable 18 so that corresponding pairs of wires 24, 30; 26, 32; 28, 34 make electrical contact.

Figure 3:
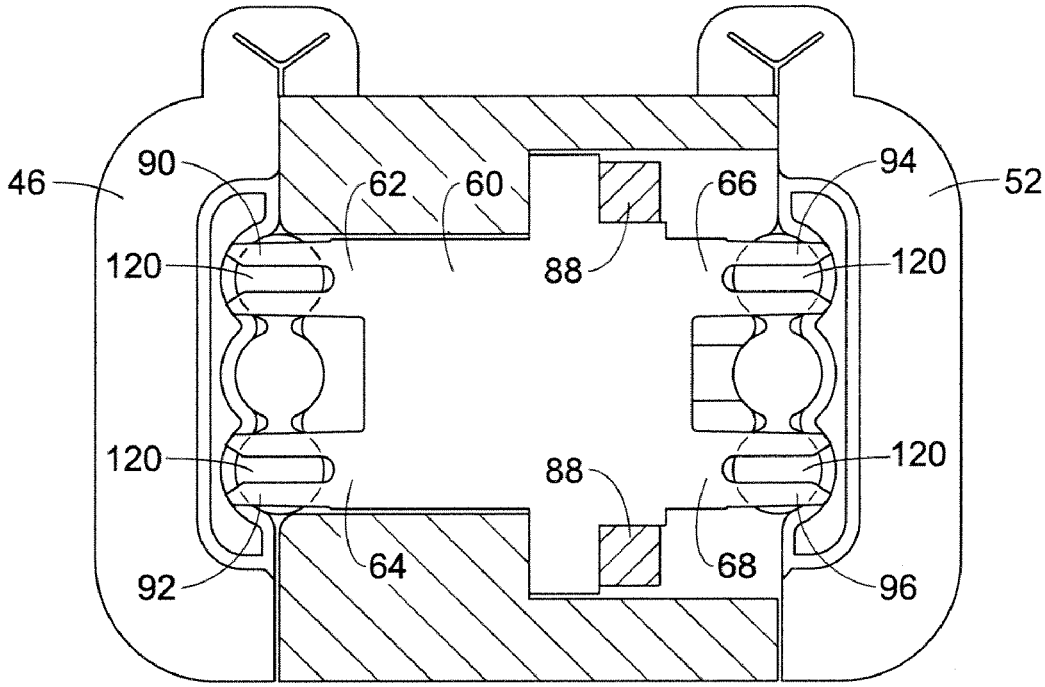
FIG. 3 is a diagrammatic illustration of a detail of connector.
Figure 4:
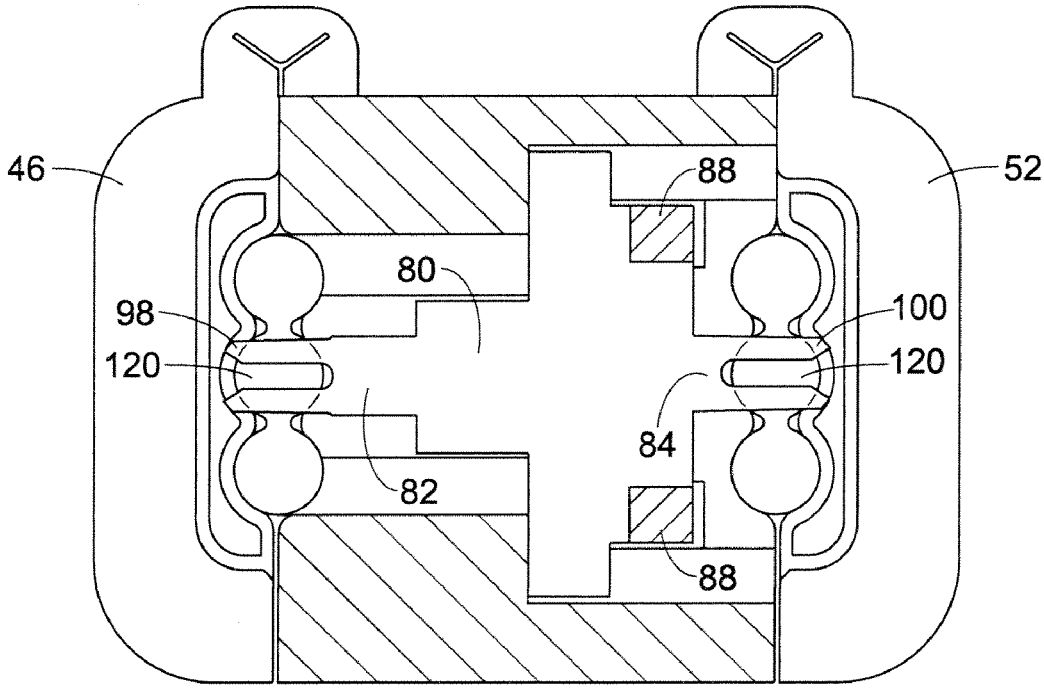
FIG. 4 is a diagrammatic illustration of another detail of a connector.

With continuing reference to FIG. 2 and further reference to FIGS. 3 and 4, a first or positive terminal or terminals 60 includes first or positive conductive insulation piercing members, or prongs 62, 64, 66, 68 that are arranged in a substantially fixed manner in slots, openings or voids 70 and protrude into the wire receiving slots 42. Likewise, a second or negative terminal or terminals 80 includes second or negative conductive insulation piercing members, or prongs 82, 84 that are arranged in a substantially fixed manner in slots, openings or voids 86 and protrude into the wire receiving slots 42. The positive and negative terminals 60, 80 include retaining features 88 such as spring back retaining features which when engaged with corresponding voids (not shown) in the main body 10, position the positive and negative terminals 60, 80 in substantially fixed manner within the main body 10.

Each prong 62, 64, 66, 68, 82, 84 includes a corresponding bifurcated or V-shaped end 90, 92, 94, 96, 98, 100 which extends out of the corresponding terminal 60, 80 toward the wire receiving slots 42. The first hinging portion 46 snaps onto the connecting portion 40 with the conductors 12 of the first cable 16 arranged in the wire receiving slots 42. The ends 90, 92, 98 of the prongs 62, 64, 82 push the conductors 12, puncture the insulating material layer 38 of the conductors 12 and electrically contact the wires 24, 26, 28. The snapping connection includes an engagement of a first engaging member or clip 110 of the first hinging section 46 with a matching recess or void 112 of the connecting portion 40 to secure the first hinging section 46 onto the connecting portion 40. Likewise, the second hinging portion 52 snaps onto the connecting portion 40 with the conductors 14 of the second cable 18 arranged in the wire receiving slots 42. The ends 94, 96, 100 of the prongs 66, 68, 84 push the conductors 14, puncture the insulating material layer 38 of the conductors 14 of the second cable 18 and electrically contact the wires 30, 32, 34. The snapping connection includes an engagement of a second engaging member or clip 114 of the second hinging section 52 with a recess or void (not shown) of the connecting portion 40 to secure the second hinging section 52 onto the connecting portion 40. As a result, the first positive prongs 62, 66 provide the electrical connection between the first positive wires 24, 30, the second positive prongs 64, 68 provide the electrical connection between the second positive wires 26, 32, and the negative prongs 82, 84 provide an electrical connection between the negative wires 28, 34 of the first and second cables 16, 18. Of course, it is contemplated that a different number of terminals and/or prongs can be used. For example, the illustrated embodiment can have two positive terminals and one negative terminal to achieve the polarity insensitive design.

In one embodiment, each bifurcated end 90, 92, 94, 96, 98, 100 defines a gap 120 sized to receive the respective conductor 12,14 of one of the first and second cable 16, 18. In one embodiment, each conductor 12, 14 includes multiple strands of wire surrounded by the insulation layer 38. The wire compressively squeezes into the gap 120 of the end 90, 92, 94, 96, 98, 100 of one of the prongs 62, 64, 66, 68, 82, 84 when the first or second hinging section 46, 52 is snapped in place onto the connecting portion 40.

In this manner, a miniature robust IDC connector is provided which includes a body having two living hinges and two terminals. The living hinges push the wires into the static terminal creating IDC connection. Such miniature connector can be assembled without special tools and, for example, placed in a tight spot or connect a miniature LED light.

Figure 5:
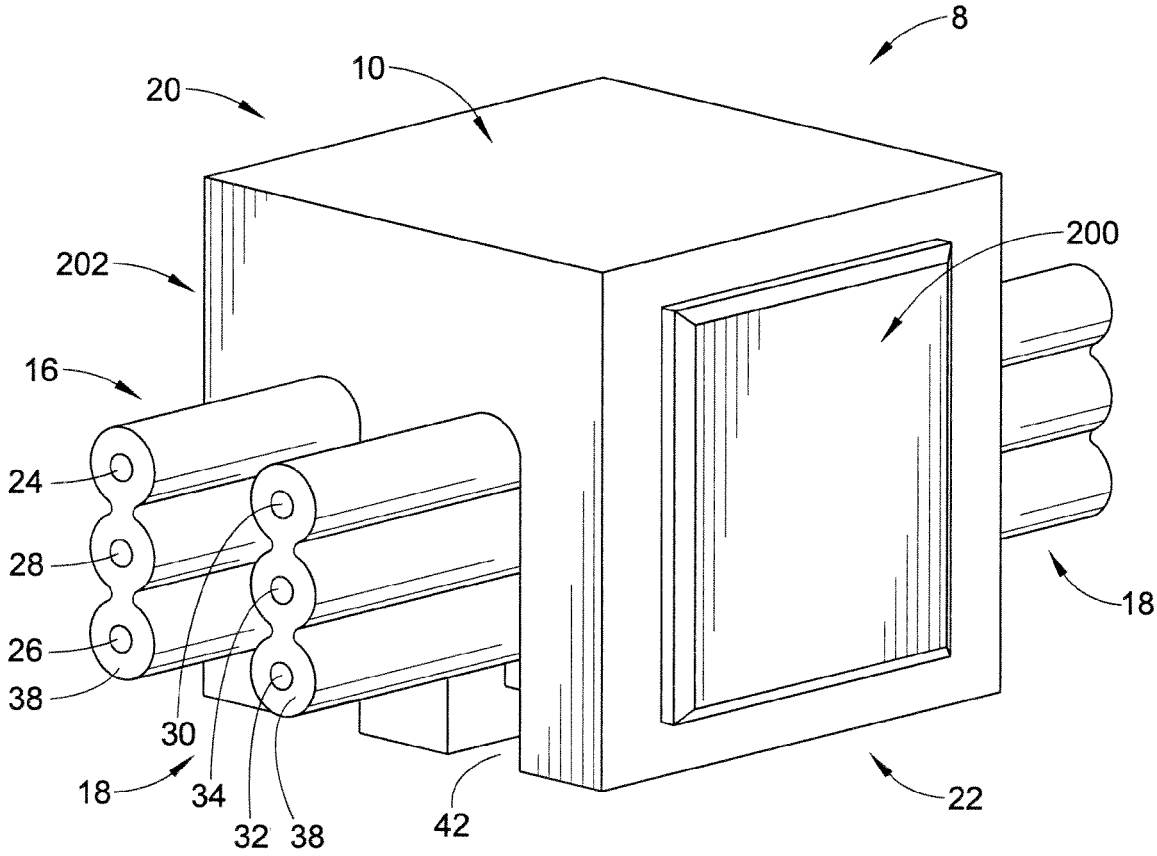
FIG. 5 is a diagrammatic illustration of another embodiment of an assembled connector.
Figure 6:
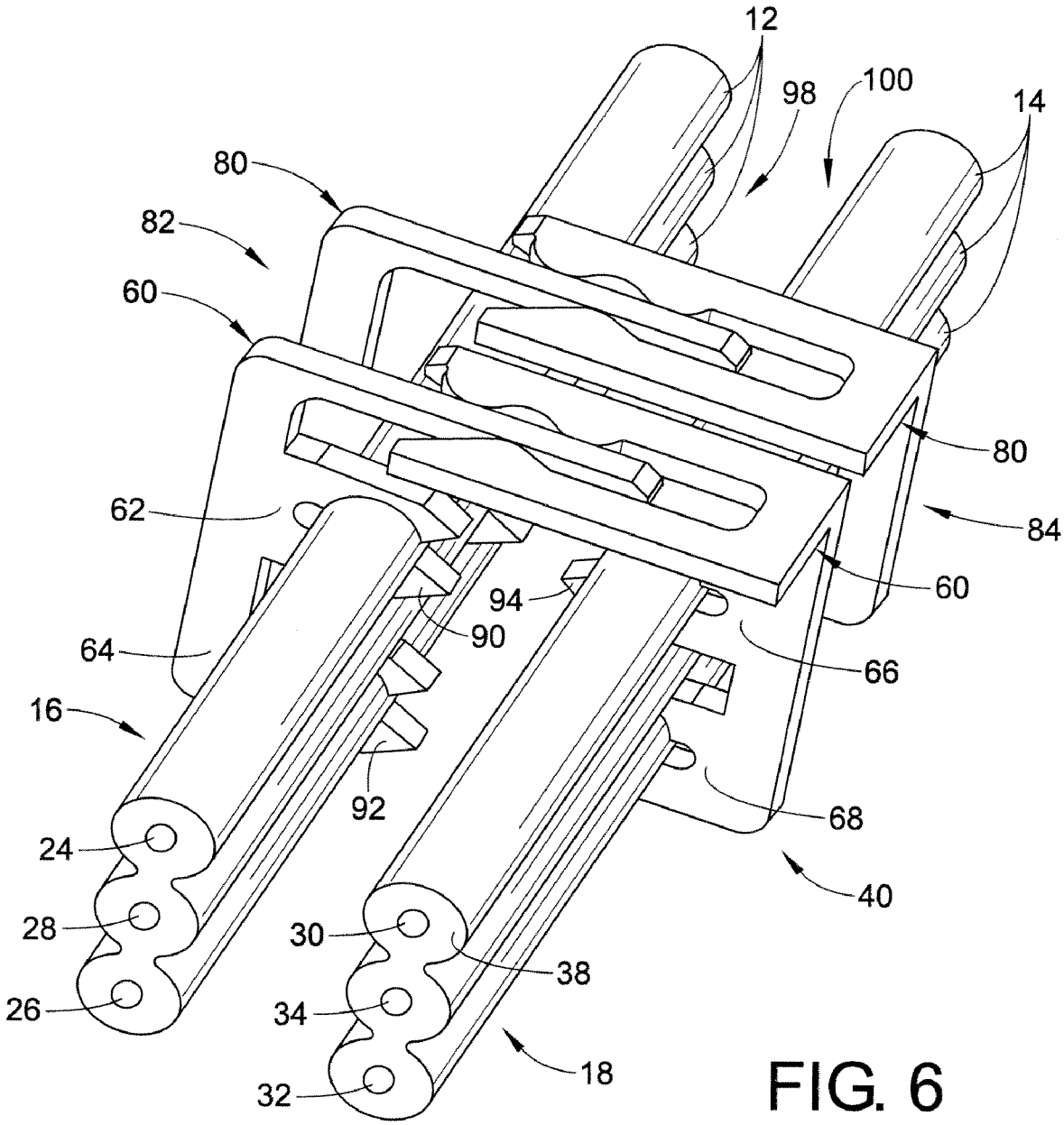
FIG. 6 is a diagrammatic illustration of a detail of the connector of FIG. 5.

With reference to FIGS. 5 and 6, the conductors 12, 14 of the first and second cables 16, 18 are received into the wire receiving slots 42. The connecting portion 40 retains and aligns the corresponding wires to be connected. The positive terminals 60 is supported by a first terminal holder 200 arranged in the connecting portion 40 and includes the first or positive conductive prongs 62, 64, 66, 68 that protrude into the wire receiving slots 42. Likewise, the negative terminals 80 is supported by a second terminal holder 202 arranged in the connecting portion 40 and includes the negative conductive insulation piercing prongs 82, 84 that protrude into the wire receiving slots 42.

Each prong 62, 64, 66, 68, 82, 84 includes a corresponding bifurcated or V-shaped end 90, 92, 94, 96, 98, 100 which extends out of the corresponding terminal 60, 80 toward the receiving slots 42. The electrical connection between corresponding wires of the first and second cables 16, 18 is achieved by squeezing the first and second terminal holders 200, 202 toward one another onto the main body 10. The squeezing of the first and second terminal holders 200, 202 results in bifurcating the ends connecting to the conductors 12, 14 of the corresponding first and second cables 16, 18 thus connecting respective pairs of wires. The terminal holders 200, 202 retain the terminals 60, 80 and interface to the main body to provide proper alignment and retention of the terminals to the main body. The terminal holders 200, 202 can also have features to position the wire during termination and have voids to retain the gel for moisture protection. The connector is scalable for the size of the wires, the number of conductors to be connected, and which wires are to be connected. The end result is a small compact IDC splice connection usable with miniature LED lights, for example, that is placed over the wires to be connected and is terminated by squeezing the connection with a standard pair of pliers.

Optionally, the main body 10 includes multiple voids to be filled with a dielectric gel that provides moisture resistance to the critical areas where the terminals connect to the wire and to each other.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A connector for electrically connecting corresponding conductors of at least first and second cables, the connector comprising:

a connecting portion having opposing first and second wire receiving slots for receiving associated first and second cables, respectively, the connecting portion further including a first set of at least two nubs associated with the first wire receiving slots and a second set of at least two nubs associated with the second wire receiving slots, the nubs being configured to retain the associated cables, and wherein the nubs of each set include a first nub spaced from a second nub along a length of the associated cable that the respective nubs retain;

a positive terminal and a negative terminal each disposed in the connecting portion and which terminate and electrically connect corresponding conductors of each cable, wherein each terminal includes a prong protruding into each wire receiving slot; and first and second hinging members which snap onto the connecting portion and contact a respective associated cable so that each prong pierces an insulative sheath of a respective cable.

2. The connector as set forth in claim 1, wherein each first and second hinging member includes:

an engaging member which engages with a matching void in the connecting portion and secures the corresponding first or second hinging member onto the connecting portion.

3. The connector as set forth in claim 1, wherein the connecting portion includes:

at least positive and negative terminal holders to which the positive and negative terminals are attached.

4. The connector as set forth in claim 1, wherein each terminal includes:

a retaining feature which fixedly retains an associated terminal within the connecting portion.

5. The connector as set forth in claim 1, further including:

voids into which dielectric gel is inserted for moisture protection.

6. The connector as set forth in claim 1, wherein the connecting portion is hermetically sealed against ambient particles.

7. A plurality of opposing first and second cables, the corresponding opposing conductors of the cables are being electrically connected by the connector of claim 1.

8. The connector as set forth in claim 1, wherein the positive terminal includes a first prong positioned in the first wire receiving slots to contact a first wire of the associated first cable and a second prong positioned in the first wire receiving slots to contact a second wire of the associated first cable.

9. The connector as set forth in claim 1, wherein a first nub of the first set of nubs and the second nub of the first set of nubs are axially aligned for retaining the associated first cable generally along an axis.

10. The connector as set forth in claim 1, wherein each set of nubs includes an upper nub that is spaced from a lower nub.

11. The connector as set forth in claim 10, wherein each set of nubs includes at least two upper nubs that are spaced from one another and at least two lower nubs that are spaced from one another.

12. An insulation displacement connector (IDC) for electrically connecting insulated cables which each includes electric conductors, comprising:

a main body which includes first and second hinging members disposed on opposite respective sides of the main body, the main body further including wire receiving slots disposed on first and second opposing surfaces of the main body, which wire receiving slots receive and align conductors of the cables at corresponding first and second surfaces, wherein the hinging members push the cables toward the wire receiving slots when the hinging members are moved toward a closed position; and a positive terminal and a negative terminal which electrically connect pairs of wires of corresponding conductors by insulation displacement method when the first and second hinging members are snapped closed.

13. The connector as set forth in claim 12, wherein each terminal includes a prong and the main body further includes:

voids disposed proximately to the first and second surfaces with which voids each prong is aligned to protrude into the wire receiving slots, pierce insulation layer of each conductor when the hinging portions are snapped closed and electrically connect to an electric wire disposed within the insulation layer of an associated conductor.

14. An insulation displacement connector (IDC) for electrically connecting at least first and second cables each cable having parallel electric wires insulated from one another by a layer of insulative material, the IDC connector comprising:

a connecting portion including wire receiving slots and wire aligning members, into which wire receiving slots the wires surrounded by the insulative material are inserted;

a positive terminal and a negative terminal each having bifurcated end and being oriented toward a corresponding wire receiving slot, which each bifurcated end pierces the insulative layer of a respective wire and establishes electrical contact with the respective wire; and first and second hinging portions disposed proximately to opposing first and second surfaces of the connecting portion, which push the insulative layer of each inserted wire onto the corresponding bifurcated end when first and second hinging portions are snapped closed onto the connecting portion.

15. The connector as set forth in claim 14, wherein the bifurcated ends pierce the insulative layers of the respective wires simultaneously.

16. The connector as set forth in claim 14, wherein the connecting portion further includes:

positive and negative terminal holders disposed proximately to opposing associated first and second surfaces of the connecting portion, to which terminal holders the positive and negative terminals are correspondingly attached, each bifurcated end is pushed into the insulative layer of the inserted wire by manually pressing the positive and negative terminal holders toward one another.

* * * * *